United States Patent [19]

Barth

[11] 4,135,777

[45] Jan. 23, 1979

[54] TILTABLE TERMINAL CLAMP ASSEMBLY

[75] Inventor: Gerald D. Barth, Elgin, Ill.

[73] Assignee: Illinois Tool Works Inc., Chicago, Ill.

[21] Appl. No.: 870,977

[22] Filed: Jan. 20, 1978

[51] Int. Cl.[2] ..... H01R 9/10

[52] U.S. Cl. ..... 339/246; 339/95 R

[58] Field of Search ..... 339/95 R, 95 A, 246

[56] References Cited

U.S. PATENT DOCUMENTS

| | | | |
|---|---|---|---|
| 3,177,456 | 4/1965 | Haydu et al. | 339/95 R |
| 3,891,296 | 6/1975 | Gutshall | 339/246 |

FOREIGN PATENT DOCUMENTS

| | | | |
|---|---|---|---|
| 2335932 | 1/1975 | Fed. Rep. of Germany | 339/246 |
| 355490 | 8/1961 | Switzerland | 339/246 |

*Primary Examiner*—Joseph H. McGlynn

*Attorney, Agent, or Firm*—Thomas W. Buckman; Robert W. Beart

[57] ABSTRACT

An improved terminal clamp assembly adapted for removably securing and electrically connecting a pair of conductor wires. A plate element of the clamp assembly is preassembled to a fastener having a threaded shank and clamping head with the plate configured so as to tilt relative to the axis of the fastener permitting the interconnection of two conductors having different diameters. A plurality of ribs, including alternately disposed sets, are formed beneath the clamping surface of the plate with each set of ribs tapering in different directions to create a plurality of laterally directed forces on a single conductor wire in different and opposing directions.

12 Claims, 7 Drawing Figures

Fig. 1
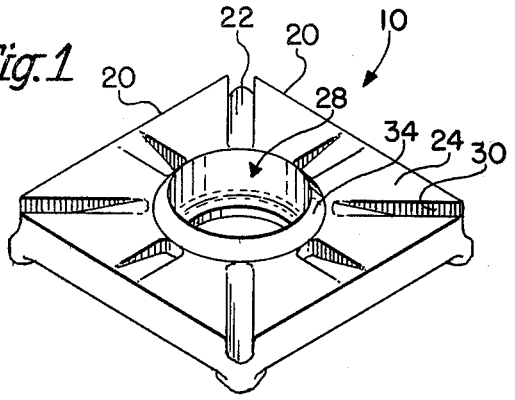
Fig. 2
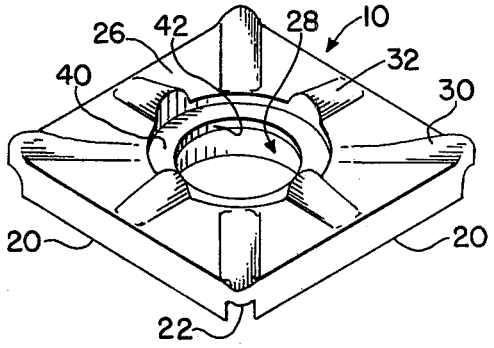
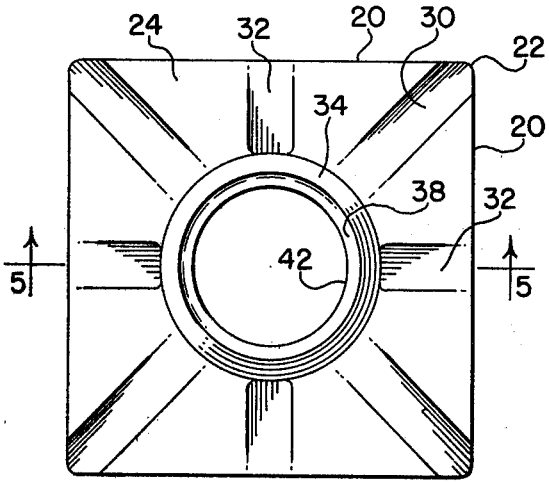
Fig. 3
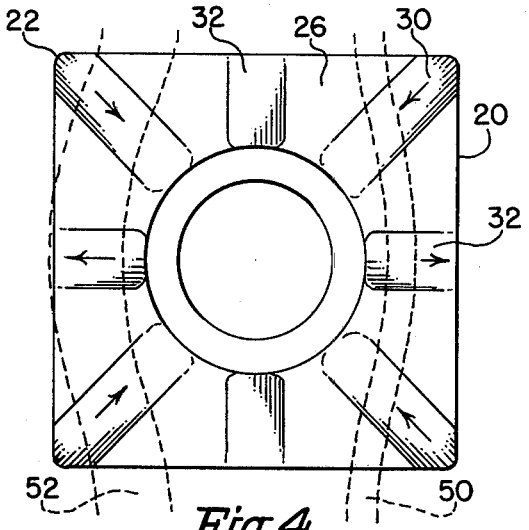
Fig. 4
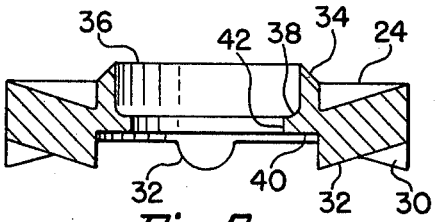
Fig. 5
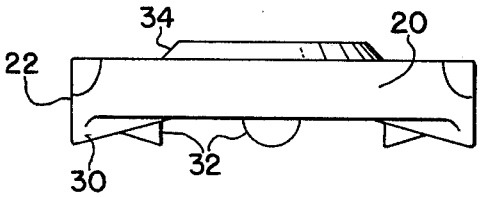
Fig. 6
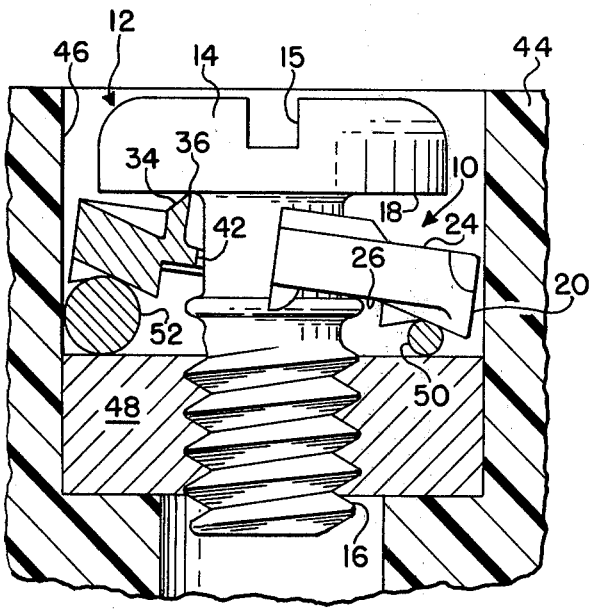
Fig. 7

TILTABLE TERMINAL CLAMP ASSEMBLY

BACKGROUND AND SUMMARY OF THE INVENTION

This invention relates generally to electrical terminal assemblies of the type wherein a pair of conductor wires are clamped by a screw activated pressure plate causing an electrical connection to be formed therebetween.

The invention is more particularly directed to a terminal clamp assembly which is capable of accepting conductor wires of dissimilar diameters and insuring that a firm and reliable clamping pressure is maintained on the pair of wires.

Certain prior art devices have been designed to incorporate a washer-type plate preassembled on a screw fastener so that the plate will clampingly engage a pair of conductor wires bringing them into electrical contact with one another. These prior art devices typically incorporate a rib structure at the undersurface of the washer to concentrate the clamping pressure on the conductor wires in an effort to insure a firm electrical contact. Such prior art devices still tend to be somewhat unreliable in that they utilize a single rib or, at most, two ribs contacting a given conductor wire. Excessive vibrations and/or external forces applied to the conductor wires may therefore tend to relax the clamping pressure on the conductors and create an unreliable electrical joint. Furthermore, the ribs in the prior art devices concentrate the clamping forces at a discrete region of the conductor to the extent that the clamping force could, in combination with vibrations and external loads, cause the conductor wire to be severed or excessively deformed.

Other prior art devices of this general type have been developed in an effort to insure the adaptability of the devices to accept a pair of conductor wires of different diameters. Tiltability of a clamping plate has, in certain prior art devices, been achieved by a particularly designed clamping surface beneath the head of a screw. For example, U.S. Pat. Nos. 3,744,012 and 3,891,296 show terminal clamps in which the tiltability is facilitated by a recess in the clamping surface of the head of a screw.

It is therefore an object of this invention to provide a terminal clamp assembly with a capability to accommodate and firmly clamp a pair of wires either of the same or of different diameters.

A further object of the invention is to provide a terminal clamp assembly having a washer-like plate with a clamping surface configured to distribute a clamping load on a plurality of discrete regions on a given conductor wire while also simultaneously applying lateral forces to the conductor wire in opposing directions.

A still further object of the invention is to provide a terminal clamp assembly in which the clamping pressure is reliably applied in a region directly adjacent the aperture of a clamping washer.

The above and other objects are achieved by a clamp assembly comprising a screw-type fastener with a generally planar polygonal-shaped washer-type clamping plate preassembled to the fastener and directly adjacent the head of the fastener. The clamping plate includes a plurality of generally radially directed ribs formed on the undersurface. The plurality of ribs comprises two sets of alternately disposed ribs. The ribs of a first set extend from the corners of the washer plate inwardly and the ribs of a second set extend from the sides of the washer plate inwardly. The ribs of the first set are formed to taper inwardly with their maximum thickness adjacent the outer periphery of the washer while the ribs of the second set are formed to taper outwardly with their maximum thickness adjacent the aperture of the washer. This configuration causes the conductor wire to be subjected to laterally directed forces in addition to clamping forces and tends to deform the conductor wire into a serpentine configuration beneath the clamping plate which enhances the capability of the wires to resist unauthorized forces axially of the conductors.

The clamping plate is further uniquely configured to include a short tubular projection directly adjacent the aperture to insure that the clamping forces are applied near the aperture rather than outwardly of the aperture. Such a structure therefore permits the plate to tilt without interference from the clamping surface of the head. Other features of the invention that contribute to its efficient operation include a reduction in the thickness of the washer at the walls of the aperture. Since the aperture size should be minimized if the washer is to be retained by conventional preassembly techniques, the axial extent of the aperture walls becomes a limiting factor in the degree of tiltability of the washer.

BRIEF DESCRIPTION OF THE DRAWINGS

Other objects and advantages of the invention will become apparent upon reading the following detailed description and upon reference to the drawings in which:

FIG. 1 is a perspective view showing the uppersurface of a clamping member of the invention.

FIG. 2 is a perspective view showing the undersurface of a clamping member of the invention.

FIG. 3 is a top plan view of the clamping member of the invention.

FIG. 4 is a bottom plan view of the clamping member of the invention showing in dotted lines the manner in which a conductor wire tends to deflect beneath the clamping surface.

FIG. 5 is a sectional view of the clamping member as taken along the lines 5—5 of FIG. 3.

FIG. 6 is a side elevational view of the clamping member.

FIG. 7 is an elevational view partly in section showing the preferred embodiment of the clamp assembly after being threaded into a workpiece and clamping two conductors of different diameters.

DETAILED DESCRIPTION OF THE INVENTION

Referring first to FIGS. 1, 2 and 7, the clamping assembly of the present invention will be shown to basically comprise a clamping washer member 10 preassembled to a screw fastener 12 having a head 14 with a rotation inducing slot 15 and a threaded shank 16 with the washer preassembled directly adjacent to the undersurface 18 of the head in a somewhat conventional manner.

The desired functions of the invention are obtained with the uniquely configured clamping washer 10. The washer is preferably polygonal, such as square, presenting an outer periphery of four equal sides 20 intersecting at corners 22. The washer is generally planar, presenting upper and lower surfaces 24 and 26 which are perpendicularly disposed to the central axis of a centrally disposed through aperture 28.

Referring more particularly to FIGS. 2 and 4 with additional reference to FIGS. 5 and 7, the several features, which in the composite permit the effective functioning of the clamping assembly, will become apparent.

The lower or clamping surface 26 of the washer is configured to include a plurality of rib-like embossments extending generally radially from the axis of the aperture toward the outer periphery of the plate. More specifically, the ribs include a first and second set of ribs alternately disposed about the axis. A first set of four ribs 30 extend from the corners 22 of the washer inwardly toward the aperture while a second set of four ribs 32 extends from the sides 20 at a point approximately midway between the adjacent corners inwardly toward the aperture. Each rib of each set may be located to extend 90° relative to its adjacent rib in the set, so that all ribs are equally spaced radially from one another. The ribs 30 that extend from the corners are, as shown in FIG. 5, configured to taper inwardly, with a maximum height adjacent the outer periphery of the washer and a minimum height adjacent the aperture 28. The ribs 32 of the second set taper generally outwardly, with a maximum height adjacent the aperture 28 and a minimum height adjacent the outer periphery of the washer.

Attention is now directed specifically to the aperture 28 of the clamping member 10 and the configuration of the upper and lower surface regions of the member directly adjacent the periphery of the aperture. A tube-like protuberance 34, closely adjacent and surrounding the aperture 28, extends a short axial distance from the remaining regions of the upper surface 24. The transverse wall dimension of the tubular extension may be relatively slight and preferably tapers inwardly as may be accomplished by a chamfer region creating an edge or very slight flat upper marginal area 36. The upper marginal surface 38 directly adjacent the aperture is slightly recessed as is the lower marginal surface 40 adjacent the aperture. Thus, the wall 42 of the aperture defines a region of reduced thickness relative to the remainder of the washer 10. The ribs will also preferably start at the outer margin of the inner recess 40 so as to not interfere with the tilting. The functions of the tube-like centrally disposed protuberance and the reduced thickness of the region surrounding the aperture will be described in greater detail later herein.

In operation, a terminal clamp assembly is typically utilized in an environment such as shown in FIG. 7 which includes an insulated base member 44 with a generally rectangular recess 46 conforming to the outer periphery of the clamping member. The walls of recess 46 cooperate with the sides 20 of the washer to resist relative rotation during clamping. The bottom of the recess includes metallic contact strip 48 to which a pair of wire conductors 50 and 52 may be secured by the clamping assembly. The particular structural features of the clamping washer member 10 described above become significant when it is desired to reliably clamp a pair of conductor wires of dissimilar diameters as shown in FIG. 7. The thin tube-like extension 34 directly adjacent the aperture 28, insures that the clamping force is reliably applied to the washer as close as possible to the shank of the fastener or to the axis of the aperture. In a tilting application, such as that described in FIG. 7, the assurance that the applicaton of force is near the aperture becomes important since the undersurface of the head could contact an outer peripheral region of the washer that has been tilted upwardly to accommodate a larger diameter conductor such as 52. An application of force at this upwardly disposed region, about a moment arm would tend to rock the washer about the larger conductor as a fulcrum causing the clamping on the smaller diameter conductor 50 to be reduced or totally eliminated. In addition to the function just stated, the existence of a small land or point at the uppermost extremity 36 of the tube greatly reduces the energy dissipated by rubbing friction contact between the undersurface of the head and the washer. Since the washer is retained from relative rotation by the cooperation of the aperture in the work panel and the polygonal configuration of the washer, there will be some frictional contact between these two elements as torque is applied to the head and clamping pressure applied to the conductor. It is desirable to maximize the energy efficiently utilized in clamping without depleting the energy due to needless frictional losses.

While the internal wall of the tube-like extension 34 is shown to be a somewhat cylindrical surface extending generally parallel to the axis of the washer, it should be understood that this innermost surface can be formed as a frustoconical surface extending upwardly and outwardly of the aperture wall 42 without significantly altering the function and scope of the invention.

In a tilting application, such as that shown in the preferred embodiment, the washer must be reasonably free to tilt a predetermined angle without interference between the side wall 42 of the aperture and the shank 16 or between the upper surface 24 of the washer and the lower surface 18 of the head. The latter restriction to tiltability is eliminated, in part, by the tube-like protuberance 34 as noted above. However, if the hole size is to be minimized in an effort to retain the washer by the crest of the threads or by an annular ring of a minimum height, the tiltability of the washer is greatly limited by the thickness of the washer at the wall of the aperture. For this reason, the thickness of the aperture is reduced by forming recesses 38 and 40 in the top surface and bottom surface respectively. It should be apparent that if the wall of the aperture were as thick as the remaining region of the plate, the angle of tilt would be substantially less for a given diameter than for that permitted by the configuration provided in this invention.

With reference again to the alternating, tapering configuration of the ribs, and with particular reference to FIG. 4, it will be shown that the inward tapering of the first set of ribs 30 will create a camming, lateral, inwardly directed force on two discrete regions of the conductor wire in addition to a downwardly directed clamping force. In cooperation with these laterally directed forces, the second set of ribs 32 tapering outwardly create an additional camming, lateral force directed outwardly on the conductor in addition to a downwardly directed clamping force at a third intermediate discrete region of the conductor. These opposing lateral forces tend to force the conductor wire into a serpentine configuration, such as that shown in dotted lines in FIG. 4. While the wire may or may not actually assume this configuration, it is the combination effect of the force vectors on the conductors that is important. The camming, lateral forces applied to the conductors aid in insuring a firm, aggressive, electrical contact between the conductors and washer even when the washer is tilted. The cooperation of the two opposing camming, lateral forces on each conductor wire also serve as a strain relief in nondestructively resisting the removal of the conductor wire along an axial direction of the wire. The clamping surface of this invention tends to be more tolerant of excessive clamping forces in that the wires can be cammed in various directions rather than be subjected to high, relatively inflexible unit force.

A further advantage is created by locating the short axial extent aperture wall 42 adjacent the lower face 26 of the washer rather than adjacent the upper face 24. This configuration limits the "washer drop" of the assembly. An assembly of this general type should have a minimum of free axial movement between the washer and the shank of the fastener so the clamping washer will be pulled upwardly from contact with the conductors with a minimum of rotation of the fastener in the loosening direction.

Thus, it is apparent that there has been provided, in accordance with this invention, a terminal clamp assembly which insures a firm and reliable clamping force on a pair of conductor wires which may be of different diameters, while permitting a freer tiltability of the plate to accommodate the different diameters. The invention described thus fully satisfies the objects and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A terminal clamp assembly including screw member with a head, a plate-like polygonally configured clamping member preassmbled to the screw adjacent the head, the clamping member including a substantially centrally disposed aperture with the upper region of the shank of the screw member extending therethrough, the clamping member undersurface having a plurality of radially directed ribs extending from adjacent the aperture to the outer periphery of the clamping member, the plurality of ribs including alternately disposed sets of ribs, the ribs of a first set tapering inwardly from a maximum height adjacent the outer periphery of the clamping member to a minimum height adjacent the aperture, the ribs of a second set tapering outwardly from a maximum height adjacent the aperture to a minimum height adjacent the outer periphery of the clamping region.

2. The terminal clamp assembly of claim 1, wherein each of the first and second sets of ribs total four with the ribs in each set extending at substantially 90° to one another, the plurality of ribs being substantially equally radially spaced from one another.

3. The terminal clamp assembly of claim 1, wherein the undersurface of the clamping plate includes an annular recess formed in the inner peripheral surface region directly adjacent the aperture reducing the thickness of the plate in that region.

4. The terminal clamp assembly of claim 1, wherein the upper surface of the clamping plate includes an annular recess formed in the inner peripheral surface region directly adjacent the aperture reducing the thickness of the plate in that region.

5. The terminal clamp assembly of claim 1, wherein the thickness of the plate at the annular recess is reduced relative to the thickness of the plate in other regions to increase the tiltability of the plate on the shank of the screw.

6. The terminal clamp assembly of claim 1, wherein the radial innermost extremities of the plurality or ribs are spaced slightly from the innermost periphery of the aperture.

7. The terminal clamp assembly of claim 1, wherein the clamping plate upper and lower surfaces are generally planar in the regions intermediate the ribs.

8. The terminal clamp assembly of claim 1, wherein the aperture is of reduced axial thickness relative to the thickness of the remaining regions of the washer with the walls of the aperture located adjacent to the lower face of the washer rather than adjacent the upper face of the washer.

9. The terminal clamp assembly of claim 1, wherein the clamping plate is square permitting the peripheral outer edges thereof to cooperate with side walls of a terminal body to prevent rotation of the clamping plate relative to the terminal body during the clamping of conductor wires thereto.

10. The terminal clamp assembly of claim 9, wherein the first and second sets of ribs total four each with the ribs of the first set extending from the corners of the square plate while the ribs of the second set extend from the side edges of the plate at positions intermediate the corners.

11. The terminal clamp assembly of claim 1, including a tube-like protuberance surrounding and closely adjacent the aperture extending a short axial distance from the remaining upper surface regions of the plate to ensure that clamping load from the screw head is applied adjacent the central axis of the clamp assembly.

12. The terminal clamp assembly of claim 11, wherein the uppermost extremity of the tube-like protuberance is chamfered inwardly reducing the radial width of the upper edge of the protuberance.

* * * * *